United States Patent [19]

Greig et al.

[11] 4,416,295

[45] Nov. 22, 1983

[54] SMOKING-MATERIAL RODS AND A METHOD OF MAKING SUCH RODS

[75] Inventors: Colin C. Greig, Salisbury; Richard G. Hook, Winchester, both of England

[73] Assignee: Union Camp Corporation, Wayne, N.J.

[21] Appl. No.: 309,489

[22] Filed: Oct. 7, 1981

[30] Foreign Application Priority Data

Oct. 17, 1980 [GB] United Kingdom ..... 8033543

[51] Int. Cl.[3] ..... A24F 1/00; A24D 1/00; A24D 1/18

[52] U.S. Cl. ..... 131/364; 131/359; 131/353

[58] Field of Search ..... 131/364, 375, 367, 358, 131/369, 353, 374, 370, 357

[56] References Cited

U.S. PATENT DOCUMENTS 3,884,247 5/1975 Detrich et al. ..... 131/275
4,092,987 6/1978 Imbert ..... 131/364

*Primary Examiner*—V. Millin
*Attorney, Agent, or Firm*—Kane, Dalsimer, Kane, Sullivan and Kurucz

[57] ABSTRACT

A rod of smoking material, for use as a smoking article or a part thereof is formed by a multiplicity of laminiform self-sustaining smoking-material elements, for example discs, extending transversely of the rod and located in face-to-face contact with one another. The thickness of the elements, which may be up to 2.5 mm, is suitably within a range of 0.1 to 0.8 mm. It may vary within the rod or from element to element along the rod. The material of the elements may have inherent smoke-permeability sufficient to afford an acceptable pressure drop through the rod or the elements may be formed or provided with smoke passages therethrough, with either the same relative distribution of passages from one element to the next or with adjacent elements so oriented in relation to each other as to provide smoke passages of predetermined form through the rod. The smoking material of the elements preferably extends over an area less than the cross-sectional area of the rod, suitably over 10 to 40% of that area. One or more additives may be applied to some or all of the elements either uniformly or in selected parts thereof. The elements may be secured together by adhesive and or by being enclosed in a wrapper. The elements may be formed with protrusions from or undulations of faces thereof.

16 Claims, 12 Drawing Figures

SMOKING-MATERIAL RODS AND A METHOD OF MAKING SUCH RODS

This invention relates to smoking-material rods for use as or in smoking articles, cigarettes for example, and to methods of making such rods.

The long established present method of machine-making smoking-material rods for cigarettes comprises feeding shredded tobacco onto a moving endless band of a cigarette-making machine to form on the band a stream of the shredded tobacco of predetermined height and width, and feeding the tobacco stream, together with a continuous web of wrapper paper, into a garniture of the making machine. In the garniture the paper is wrapped about the toabcco and lap seamed. The continuous wrapped rod issuing from the garniture is cut into rod lengths suitable for cigarette use. Although some attempts have been made to adapt this method of rod making to the production of rod having a smoking-material composition which varies within the rod in a predetermined manner, see United Kingdom Patent Specification No. 1,382,266 and U.S. Pat. No. 3,902,504, the means required are complex and the range of rod-construction variations is limited.

It is an object of the present invention to provide a novel construction and method of making smoking-material rod, whereby opportunities for improved flexibility of rod design are provided.

The present invention provides a rod of smoking-material for use as or for constituting part of a smoking article, which rod is formed by a multiplicity of laminiform smoking-material elements, which extend transversely of the rod and are located in face-to-face contact with each other. Preferably the elements are fixed together.

The smoking-material elements may be formed of tobacco leaf lamina, of reconstituted tobacco sheet, of a tobacco substitute in sheet form or of any other sheet form material suitable for inclusion in the smoking-material rod of a smoking article. The thickness of the elements is advantageously up to about 2.5 mm, and preferably within a range of about 0.1 mm to about 0.8 mm. The thickness of the elements within the rod may vary. The length of the rod may be such that the rod is suitable for constituting the smoking-material rod of a smoking article, a cigarette for example, or it may be of a shorter length and intended to form a sub-unit of a smoking-material rod of a smoking article.

Obviously, the laminiform smoking-material elements must be of sufficient smoke permeability as to provide for an acceptable overall pressure drop through the smoking-material rod. If the elements are formed of reconstituted tobacco or of a tobacco substitute material, they may be manufactured in such manner as to possess sufficient inherent smoke permeability. Alternatively, smoke passages may be formed in the elements subsequently to the production thereof. The passages in each element, whether inherent or formed subsequently to the production of the elements may be so distributed that they occupy an identical relative distribution from one element to the next, in which case adjacent elements may be so relatively angularly oriented as to provide a predetermined form of smoke passage through the smoking material rod. Obviously, the distribution of passages from one element to the next can vary if required.

In the interests of economy of material usage the laminiform elements may extend on average over an area which is considerably less than the cross-sectional area of the smoking-material rod of which they form part.

Advantageously the material of the elements extends on average over less than 50% of the rod cross-section and preferably extends on average over 10–40% of the rod cross-section.

Additives may be applied to or incorporated in some or all of the elements. Such additives may be applied or incorporated uniformly across the elements or alternatively to or in selected areas, an annular or axial zone for example.

The present invention also provides a method of making a rod of smoking-material for use as or for constituting part of a smoking article, wherein a multiplicity of laminiform smoking-material elements are arranged in face-to-face contact, such that each of said elements extends transversely of the rod, and said elements are subjected to a fixing process.

Advantageously the smoking-material elements are of discal form. Preferably in the making of the rod the elements are disposed horizontally thus to form a vertically extending stack. Each element may initially form part of an array of elements, possibly derived from a continuous sheet of smoking material, each element being attached to its neighbors by projecting links which are cut away to leave the formed rods subsequent to the stacking of the element arrays.

The elements may be fixed by use of an adhesive applied thereto or by means of intrinsic adhesive properties of the elements. Alternatively the elements may be fixed relatively to each other by wrapping them in a paper or other wrapper.

In order that the invention may be clearly understood and readily carried into effect, reference will now be made, by way of example, to the accompanying diagrammatic drawings, in which.

Figure 5A:
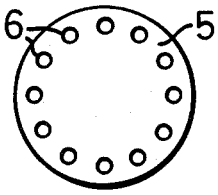
Figure 5B:
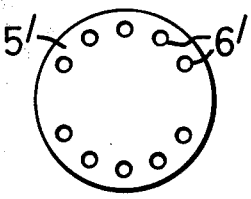
Figure 6:
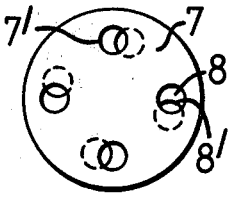
Figure 7:
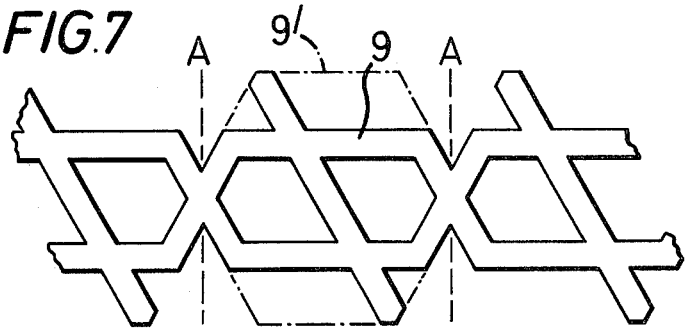
Figure 8:
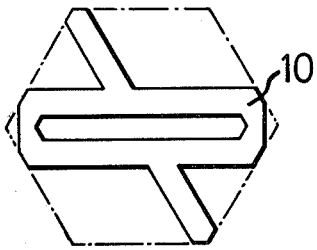
Figure 9:
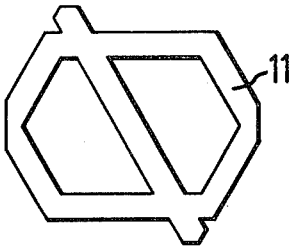
Figure 10:
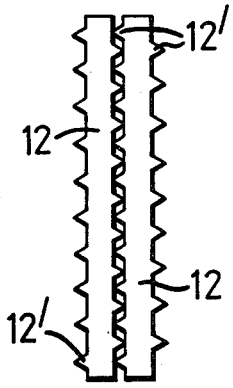
Figure 11:
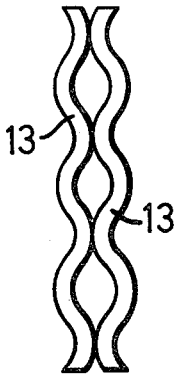

FIGS. 5*a* and 5*b* show a pair of discs intended for use together to provide for some closed smoke passageways;

FIG. 6 shows a pair of superimposed discs;

FIG. 7 shows a portion of a continuous string of laminiform elements of non-discal form;

FIGS. 8 and 9 show elements of similar configuration to those of FIG. 7 but of different forms; and FIGS. 10 and 11 show further forms of elements which may be used in the formation of a cigarette rod.

Figure 1:
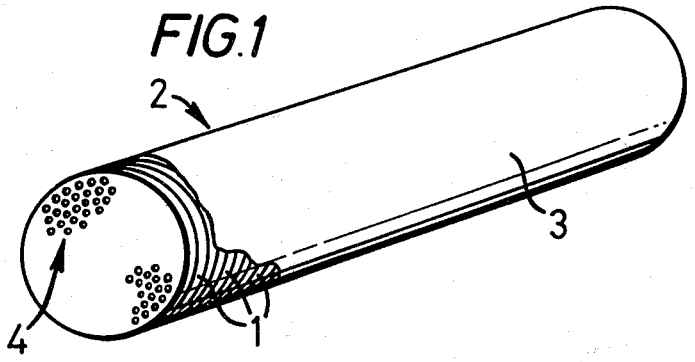
FIG. 1 shows a perspective view of a cigarette rod comprising a multiplicity of discal elements of reconstituted tobacco, each disc having an array of circular holes extending therethrough.

The multiplicity of reconstituted tobacco discal elements 1 of the cigarette rod 2 of FIG. 1 are wrapped in a cigarette paper 3. Through each of the elements 1 there extends an array of 1024 circular holes 4 each of 0.2 mm diameter. Some of the holes in an end element 1 have been shown in FIG. 1 but for the sake of clarity they have been drawn with an enlarged diameter relative to the element diameter. It will also be appreciated that the thickness of the elements 1 is exaggerated in FIG. 1.

The disposition of the holes 4 is uniform throughout the elements 1 and each element is so angularly oriented relative to the immediately underlying element that 1024 smoke passageways are provided, each of which passageways extends from one end of the rod 2 to the other end thereof parallel with the axis of the rod 2.

The total weight of the reconstituted tobacco forming the elements 1 is 1.00 g, the length of the rod 2 is 7 cm and the overall draw resistance of the rod 2 measured at an air flow rate of 17.5 $cm^3$/sec. is 5.74 cm(WG).

If instead of 1024 passageways of 0.2 mm diameter, 1561 passageways of 0.18 mm diameter extended through the rod, the weight of the reconstituted tobacco of the elements 1 would be reduced from 1.00 g to 0.58 g, representing a weight saving of 42%.

Figure 2:
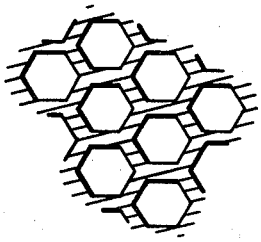
FIGS. 2–4 show much enlarged views of patterns of holes of non-circular form.
Figure 3:
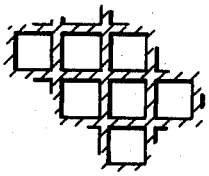
Figure 4:
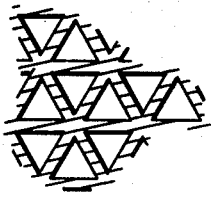

If the 1024 circular cross-sectional passageways of 0.2 mm diameter were to be replaced by the same number of passageways, but with the passageways having non-circular cross-sections of the same area as that of the 0.2 mm diameter passageways, draw resistances (pressure drops) for the rod other than 5.74 cm(WG) are obtainable. Thus a hexagonal cross-section for the passageways yields a rod pressure drop of 6.07 cm(WG), and a square cross-section a rod pressure drop of 6.51 cm(WG). A cross-section of isosceles triangle form results in a rod pressure drop of 7.93 cm(WG). Suitable arrays of hexagonal, square and triangular holes are illustrated respectively in FIGS. 2–4. If the passageways are of a narrow rectangular cross-section, the major dimension being ten times the minor dimension, the resulting rod pressure drop is 29.31 cm(WG).

By suitably varying the number, shape and size of the passageways it is possible to obtain various rod weights for a given rod pressure drop.

In FIG. 5*a* there is shown a discal element 5 comprising a ring of twelve equiangularly spaced holes 6. Discal element 5' of FIG. 5*b* comprises a ring of holes 6' identical to the ring of holes 6 of element 5 except that at two diametrically opposed positions of element 5', corresponding to positions of element 5 in which holes 6 are located, there are no holes in element 5'. If in a cigarette rod composed of a stack of discal elements as per element 5 with the holes 6 aligned to provide smoke passageways, there is included an element as per element 5', with the holes 6' thereof aligned with the holes 6 of the element 5, two of the twelve passageways will be blocked. The element 5' may be located at or near to that end of the cigarette rod intended to be the mouth end thereof, in which case the two blocked smoke passageways will remain blocked throughout the smoking of the cigarette rod. Alternatively, the element 5' may be located in the cigarette rod at a position such that it is consumed during the smoking of the cigarette rod. In the latter case the pressure drop of the cigarette rod will decrease upon the consumption of the element 5'. Prior to the consumption of the blocking element 5', although the cigarette rod has a higher pressure drop than that which would be exhibited by the rod if the blocking element 5' was omitted, the rod has nevertheless a lower weight than would be the case if the blocked passageways did not exist. The use of a blocking element 5' at a position in the cigarette rod ensuring the consumption of the element 5' during smoking of the rod permits the attainment of a predetermined total particulate-matter delivery profile.

FIG. 6 illustrates a pair of superimposed discal elements 7, 7' each of which comprises four equiangularly spaced holes 8, 8'. As may be seen from FIG. 6, the holes 8, 8' are only partially aligned. Thus the smoke passageway defined by a pair of holes 8, 8' is of a lesser cross-sectional area than that of each of the individual holes. Obviously the pressure drop is higher than would be the case if the holes were in axial alignment. A cigarette rod may be composed of a stack of elements as per the elements 7, 7', in which stack the majority of the holes 8, 8' are in axial alignment. In the stack there could be included one or more pairs of elements relatively disposed such that the holes of one element are partially non-aligned with the holes of the other element.

Alternatively over a portion or the whole length of a stack of such elements each element could be angularly oriented with respect to the next succeeding element such as to provide four helical, spiral or circuitous smoke passageways.

All of the above laminiform elements are of discal form. However, this need not be the case. Thus, for example, a cigarette rod may be composed of a stack of laminiform elements of, for example, reconstituted tobacco, which elements are of a configuration such as that illustrated in FIG. 7. The configuration of the element 9 depicted in FIG. 7 derives from a notional hexagonal outline 9'. The surface area of the element 9 is less than 50% of that of the notional hexagon 9' and, of course, accounts for an even lesser percentage of the area of a circle which would just encompass the hexagon 9'.

As may be seen in FIG. 7 the element 9 may be a member of a continuous string of such elements, in which case the string may be folded concertinawise at the boundary lines A so as to form the stack of the elements 9. A number of such stacks may be superimposed one upon another with differing angular orientations such that there is built up a cigarette rod having a generally hexagonal peripheral surface. The elements 10 and 11 respectively of FIGS. 8 and 9 are of the same general configuration as the element 9 of FIG. 7, and are derived from hexagons of the same dimensions as the hexagon 9', but are of different sizes.

By use of elements 9, 10 and 11 in suitable combination and relative angular orientations there may be provided cigarette rods having a desired pressure drop but of low weight compared with that of an orthodox rod of similar pressure drop. The desired pressure drop derives from the tortuosity of the smoke passages resulting from the superimposition of the elements 9, 10 and 11 at varying angular orientations. The degree of tortuosity may be varied independently of rod density. When a cigarette rod composed of a multiplicity of elements 9, 10 and 11 of suitable angular orientation is wrapped in a wrapper of suitable stiffness the wrapper will assume a generally cylindrical form.

Any of the laminiform elements above described with reference to FIGS. 1–9 may be made of reconstituted tobacco. Alternatively they may be made of tobacco substitute, tobacco leaf lamina or any other material suitable for inclusion in the smoking-material rod of a smoking article. If an element carries an additive, the element could be of paper, for example.

In order to obtain a weight saving additional to that deriving from the provision in the laminiform elements of openings which serve to define smoke passageways in the formed rod, elements may be provided of which one or both faces are formed with protrusions or undulations. Each of the elements 12 shown in FIG. 10 has both faces formed with protrusions 12'. FIG. 11 shows a pair of elements 13 having undulating faces.

By arranging that the laminiform elements of one zone of the cigarette rod are of a different constitution and/or density from that of an adjacent zone, it may be provided that the respective smoulder rates of the zones are different.

What is claimed is:

1. A rod of smoking material, for use as at least part of a smoking article, which is formed by a multiplicity of laminiform self-sustaining smoking-material elements extending transversely of the rod and located in face-to-face contact with one another, wherein the elements are provided with smoke passages therethrough.

2. A rod according to claim 1, wherein the elements are secured together.

3. A rod according to claim 2, wherein the thickness of the elements is up to 2.5 mm.

4. A rod according to claim 2, wherein the thickness of the elements is within a range of 0.1 to 0.8 mm.

5. A rod according to claim 2, wherein the thickness of the elements varies along the rod.

6. A rod according to claim 2, wherein the smoking material of the elements has inherent smoke-permeability sufficient to afford an acceptable pressure drop through the smoking-material rod.

7. A rod according to claim 2, wherein the smoking material of the elements extends over an area less than the cross-sectional area of the rod.

8. A rod according to claim 2, wherein the smoking material of the elements extends on average over from 10 to 40% of the cross-sectional area of the rod.

9. A rod according to claim 2, wherein the elements are of disc shape and assembled in stack form.

10. A rod according to claim 2, wherein the elements, prepared in strip form, are folded to stack form.

11. A rod according to claim 2, wherein at least one additive is applied to at least some of the elements.

12. A rod according to claim 2, wherein the elements are secured together by adhesive means.

13. A rod according to claim 2, wherein the elements are secured by being enclosed in a wrapper.

14. A rod according to claim 2, wherein the elements have protrusive formations.

15. A rod according to claim 1, wherein the smoke passages in each element have the same relative distribution from one element to the next.

16. A rod according to claim 1, wherein adjacent elements are so oriented in relation to each other as to provide smoke passages of predetermined form through the rod.

* * * * *

UNITED STATES PATENT AND TRADEMARK OFFICE

CERTIFICATE OF CORRECTION

PATENT NO. : 4,416,295

DATED : November 22, 1983

INVENTOR(S) : Colin C. Greig et al

It is certified that error appears in the above—identified patent and that said Letters Patent is hereby corrected as shown below:

On Page 1, under Assignee, Replace "Union Camp Corporation, Wayne, N.J." with -- BRITISH-AMERICAN TOBACCO COMPANY LIMITED, London, England --

Signed and Sealed this

*Twenty-seventh* Day of *March 1984*

[SEAL]

*Attest:*

GERALD J. MOSSINGHOFF

*Attesting Officer*

*Commissioner of Patents and Trademarks*